United States Patent [19]

Smith, Jr.

[11] 4,360,997

[45] Nov. 30, 1982

[54] BALING APPARATUS AND METHOD

[75] Inventor: George F. Smith, Jr., Newville, Ala.

[73] Assignee: Hergeth, Incorporated, Spartanburg, S.C.

[21] Appl. No.: 186,193

[22] Filed: Sep. 11, 1980

[51] Int. Cl.[3] ..... B65B 1/24; B65B 63/02

[52] U.S. Cl. ..... 53/528; 53/592; 53/176; 53/218; 100/255

[58] Field of Search ..... 53/399, 53/436, 461, 528, 592, 176, 218; 100/255

[56] References Cited

U.S. PATENT DOCUMENTS

| | | | |
|---|---|---|---|
| 199,360 | 1/1878 | Ertel | 100/255 |
| 1,221,767 | 4/1917 | Rowley | 53/528 |
| 1,352,345 | 9/1920 | Becker | 53/528 |
| 1,985,438 | 12/1934 | Bethel | 100/255 X |
| 3,816,970 | 6/1974 | Van Doorn | 53/528 |

FOREIGN PATENT DOCUMENTS

| | | | |
|---|---|---|---|
| 975882 | 11/1964 | United Kingdom | 53/528 |

*Primary Examiner*—John Sipos

*Attorney, Agent, or Firm*—Wellington M. Manning, Jr.; Luke J. Wilburn, Jr.

[57] ABSTRACT

A baling apparatus and method utilizes a reciprocable ram which cooperates with a baling chamber having a fixed wall platen at one end and having movable side wall means which is locked in its closed wall forming position during baling strokes of the ram but which is movable to an open position so as to afford access to baled material thereby to facilitate enveloping the baled material with a bagging sheet on the ram and by another bagging sheet mounted on the fixed platen toward which and away from which the ram is movable during baling, the bagging sheet which is associated with the ram being arranged with its central portion overlying the baling face of the ram and with its peripheral portion disposed in a bagging chamber disposed about the periphery of the ram and having vertical and horizontal doors which during baling operations are closed but which are opened after a bale is formed in order to allow manual access to the bagging sheets whereby the bagging sheets are wrapped and tied about the baled material.

9 Claims, 7 Drawing Figures

BALING APPARATUS AND METHOD

TECHNICAL FIELD

This invention relates to baling of material such as cotton or paper fiber or other substances in order to facilitate disposal or transport thereof to a point of use.

BACKGROUND ART

Known baling apparatus utilizes a baling chamber into which a ram is reciprocable along a horizontal path and which is provided with a movable wall forming that part of the chamber which is opposite from the ram. In this type of structure a formed bale is pushed out of the baling chamber by operation of the ram but such known devices are not adapted to facilitate enveloping baled material with bagging held in place with ties disposed thereabout. Bales formed without bagging are not securely formed and may result in littering of the baled material and in some instances the baled material may expand and when stacked in closed spaces may cause handling problems.

DISCLOSURE OF INVENTION

According to this invention in one form, a baling chamber through which a reciprocable baling ram is movable is provided with movable wall sections which are in closed bale forming positions during baling operations but which are movable to open positions so as to afford access to baled material. According to a feature of this invention, a sheet of bagging is arranged with its central portion overlying the baling face of the ram and with its peripheral portions tucked into a bagging cavity disposed about the periphery of the ram and closed by access doors during baling operations but which may be open upon completion of a baling operation to accommodate placement of the bagging over adjacent side, top and bottom portions of the baled material. A fixed platen forms the wall of the baling chamber which is opposite from the ram and is arranged to receive a second bagging sheet in overlying relation and whose peripheral portions are tucked along the edges of the platen and held in position by the movable wall sections when such sections are closed but which are readily accessible for placement about adjacent portions of baled material after a bale compressing operation is completed.

BEST MODE OF CARRYING OUT THE INVENTION

Figure 1:
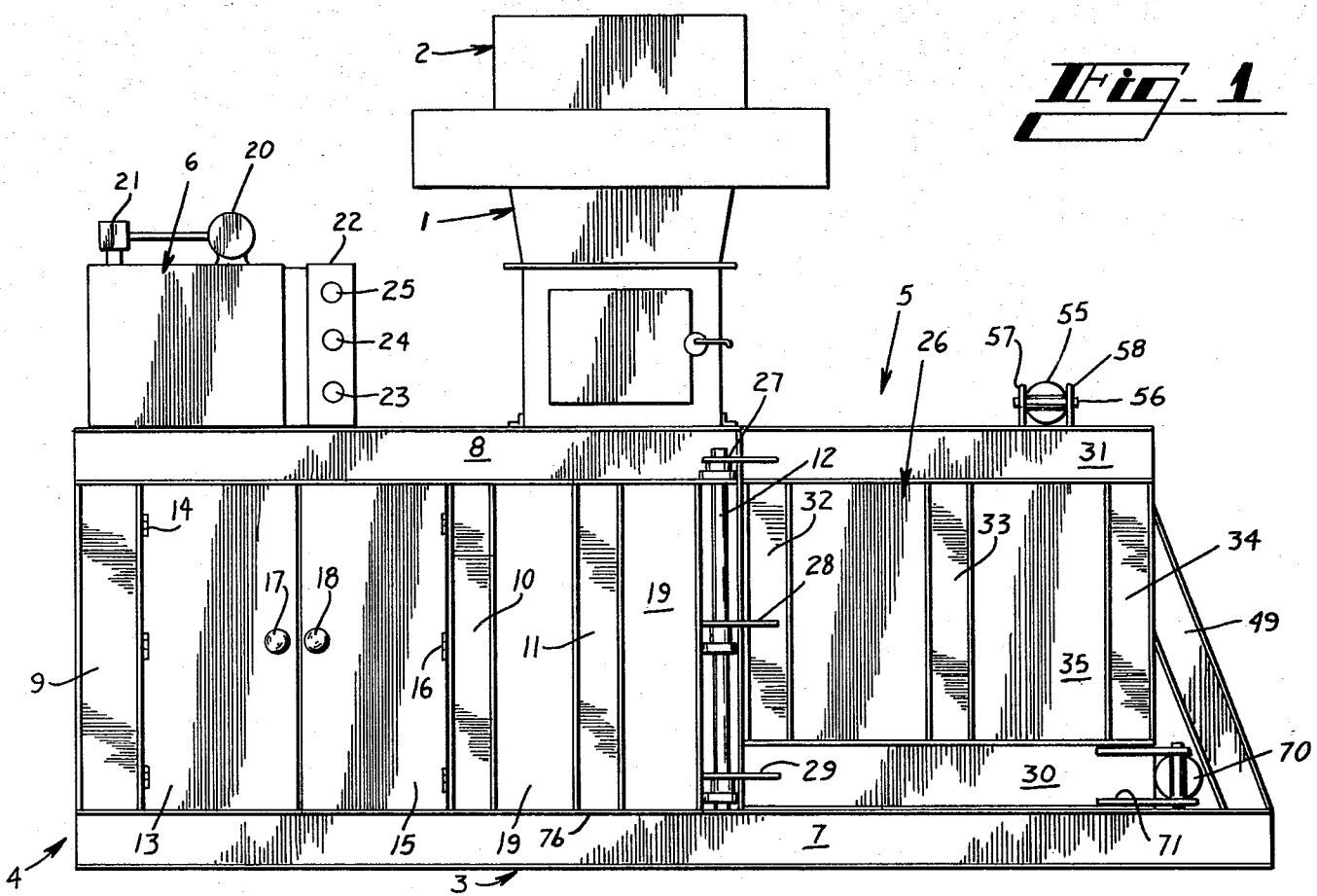
FIG. 1 is an overall side view of a baling apparatus formed in accordance with this invention.
Figure 2:
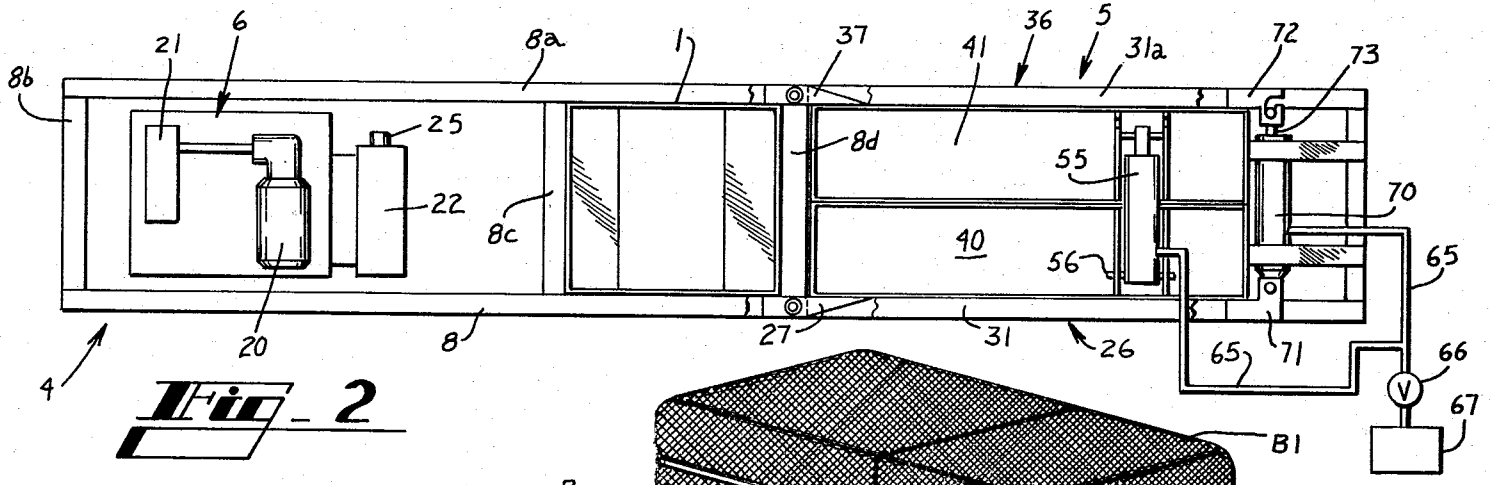
FIG. 2 is a top view of the apparatus shown in FIG. 1.
Figure 7:
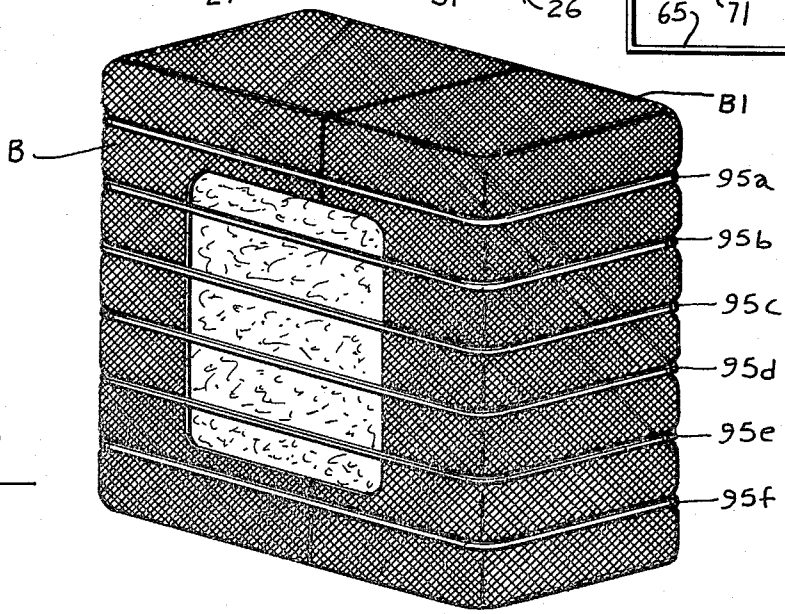
FIG. 6 is a view similar to FIG. 1 but which shows the baling chamber in open position and depicts an intermediate step in enveloping the baled material with bagging and with ties and FIG. 7 is a perspective view of a completed bale formed according to this invention.

With reference to FIGS. 1 and 2, the numeral 1 generally designates a closed receiving hopper into which material to be baled is conveyed by a conduit generally designated by the numeral 2. Since the material conveying system is closed, air pollution is minimized. Conveyance of the material may be by vacuum, gravity or by forced air. The numeral 3 generally designates a material collection chamber which is mounted on a support frame generally designated by the numeral 4. The baling chamber is generally designated by the numeral 5 and mechanism for reciprocably operating a ram horizontally through collection chamber 3 and baling chamber 5 is shown schematically in FIGS. 1 and 2 and is designated generally by the numeral 6. Hydraulic mechanism 6 including its motive means and its control mechanism is of conventional construction and as such forms no part of this invention.

Support frame 4 comprises horizontal support channel 7 and upper support channel 8. The frame structure also includes vertical channels 9, 10, 11 and 12. Of course the opposite side of the machine from that depicted in FIG. 1 is of similar construction and its parts are herein designated by corresponding numerals to which the suffix "a" is added. A base plate **7*b* is disposed in overlying relation to horizontal support channel 7 and a corresponding channel on the opposite side of the machine. This base plate 7*b* extends throughout the length of channel 7 and its counterpart on the opposite side of the machine. An access door 13 is hinged at 14 to channel 9 while access door 15 is hinged at 16 to channel 10. These doors may be arranged for bolting in closed position or may be provided with a manual release mechanism schematically indicated at 17 and 18**.

The collection chamber includes vertical channels 10, 11 and 12 and side plate 19 which extends from the left hand edge of channel 10 to the right hand edge of channel 12. A similar plate is disposed on the opposite side of the machine. Horizontal channels 8 and **8*a* are interconnected by transverse supporting channels 8*b*, 8*c* and 8*d*. A safety cover plate covers all open area between 8*b* and 8*c***.

The hydraulic mechanism generally designated by the numeral 6 includes a motor and pump generally designated by the numeral 20 together with a valve mechanism designated by the numeral 21. A control panel 22 is provided with "Forward" control button 23, a "Reverse" control button 24 and a three position control button 25 marked "Hand-Off-Automatic". The hydraulic mechanism is of conventional construction and includes a cylinder and piston mechanism not shown in the drawings but mounted behind access doors 13 and 15. Of course the piston rod R2 is mechanically secured to the ram and operation of the hydraulic mechanism imparts reciprocatory motion to the ram through the collection chamber 3 and the baling chamber 5.

Figure 3:
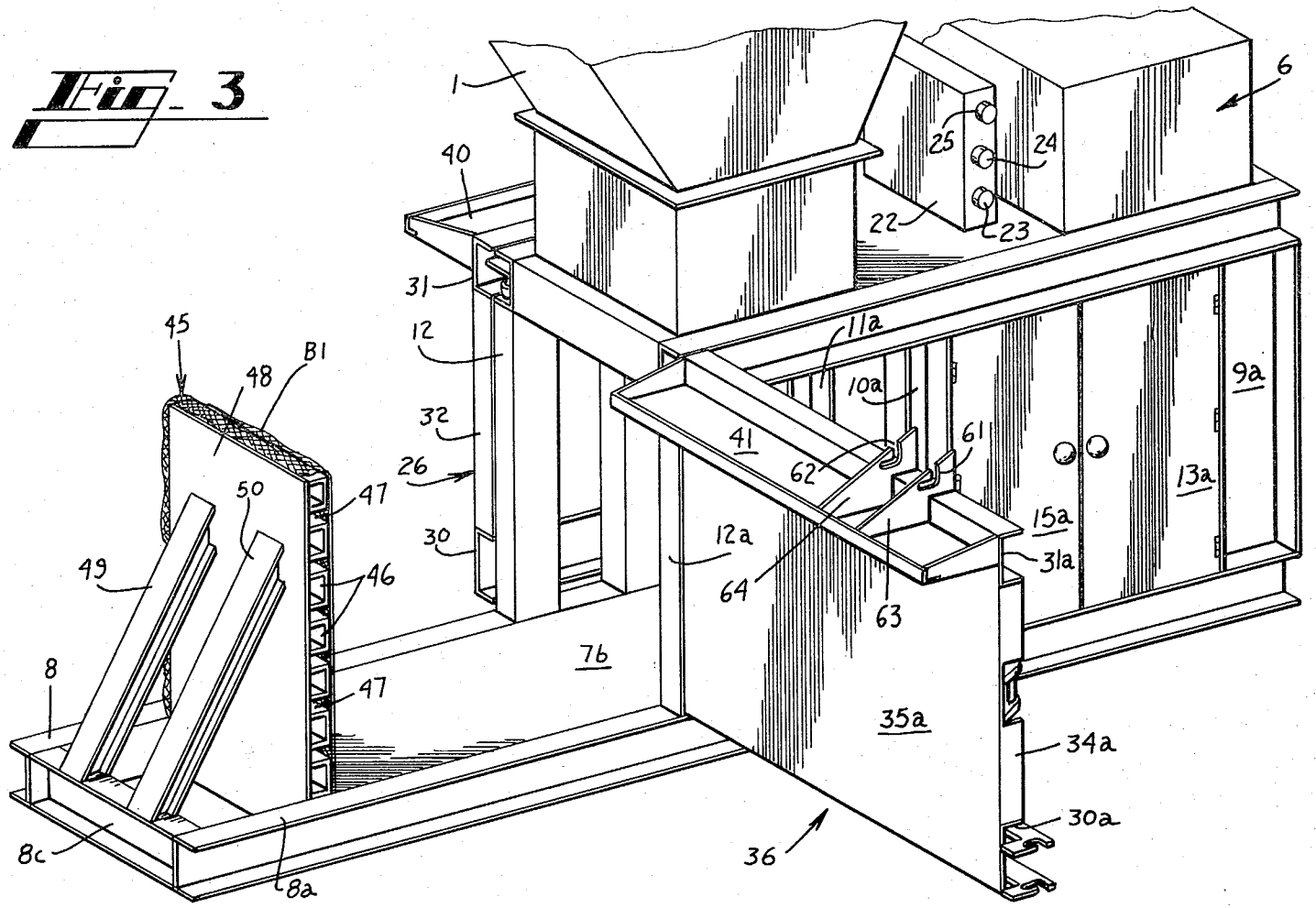
FIG. 3 is an isometric view of parts of the apparatus shown in FIGS. 1 and 2 and which depicts one wall section of the baling chamber in open position.
Figure 4:
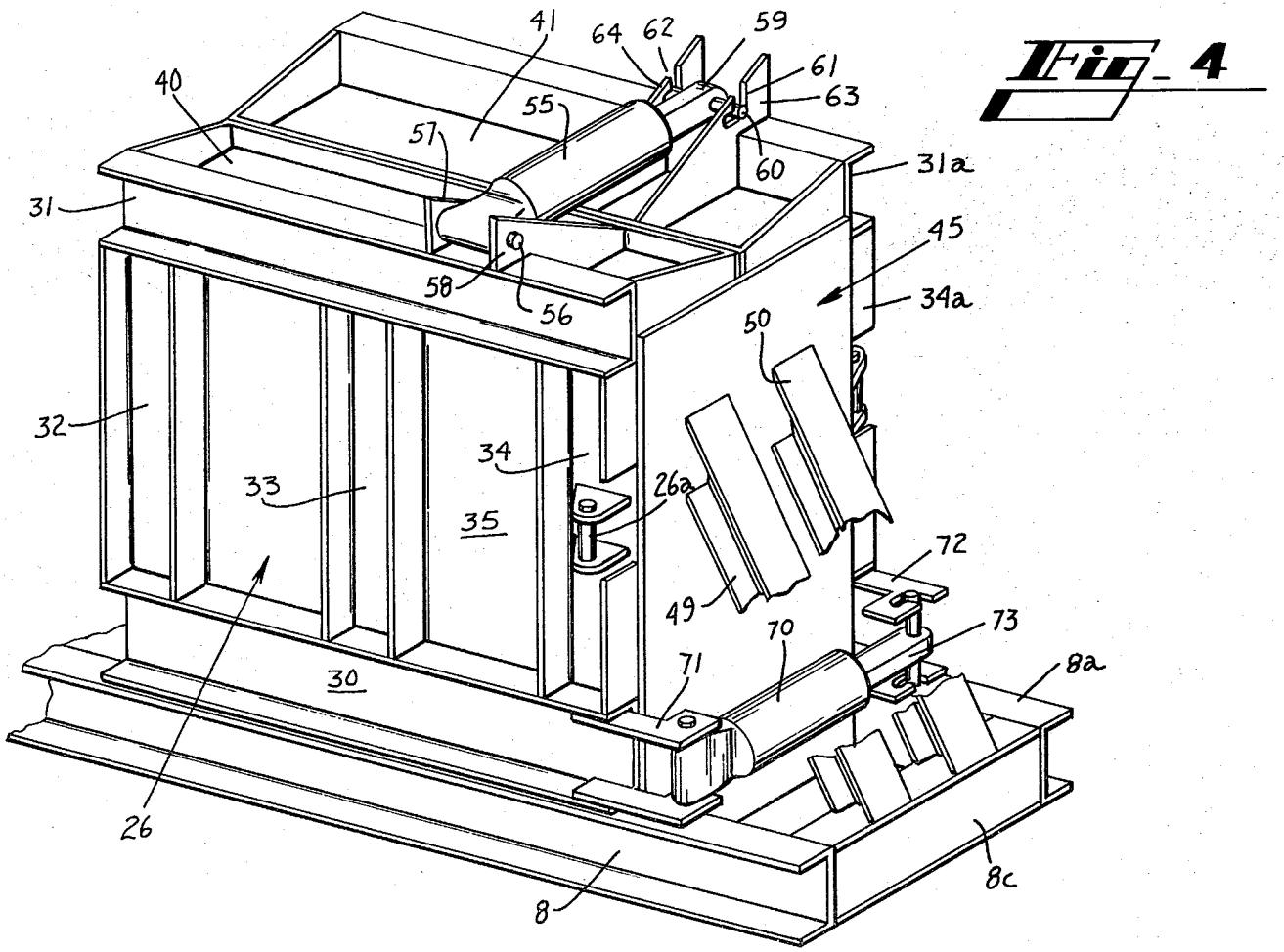
FIG. 4 is an isometric view of a portion of one end of the apparatus shown in FIG. 3 and which shows one wall section in its closed baling position.

In accordance with a feature of this invention, the baling chamber 5 is provided with movable wall sections for affording access to a formed bale in order to facilitate applying bagging thereto. With reference to FIGS. 1 and 2, wall section 26 is pivoted by hinges 27, 28 and 29 to channel 12. Wall section 26 includes a lower horizontal channel 30 and an upper horizontal channel 31 interconnected by vertical channels 32, 33 and 34. A wall plate 35 is secured on the inner surface of channels 32, 33 and 34. On the opposite side of baling chamber 5 a movable wall section 36 is pivoted to channel 12*a* on the opposite side of the apparatus by means of hinges such as 37. Movable wall section 36 is of similar construction to movable wall section 26 in that a top channel 31*a* is provided together with a bottom channel 30*a*. Also vertical channels are provided as well as an interior wall plate 35*a* similar to wall plate 35. Each of the wall sections 26 and 36 includes a top section best shown in FIGS. 2 and 3 and designated by the numerals 40 and 41.

The portion of the baling chamber 5 which is opposite from the ram R comprises a platen 45 having a plurality of channels 46 which are horizontally disposed and vertically spaced apart to define horizontal grooves 47. Channels 46 are welded or otherwise secured to a vertically disposed backing plate 48 secured at its lower edge to the horizontal support beams 8 and 8*a*. Platen 45 is braced by a pair of angularly disposed bracing members 49 and 50 which are welded or otherwise secured at their upper ends to the backing plate 48 and at their lower ends to the cross beam 8*c*.

The baling chamber 5 thus includes base plate 7*b*, the movable wall sections 26 and 36, the platen 45, the top portion of the baling chamber comprising the top sections 40 and 41 of the movable wall sections 26 and 36.

The wall sections 26 and 36 are moved to their closed positions by manual handle 26*a* and by hydraulic means and are held in their closed positions during a baling operation by locking means. Thus as is apparent in FIGS. 1, 2, 3 and 4 hydraulic cylinder 55 is pinned at 56 to a pair of ribs 57 and 58 which are welded or otherwise secured to the top section 40 of wall section 26. A piston rod 59 is provided with a cross pin 60 which is arranged for insertion into slots 60 and 62 formed in ribs 63 and 64 respectively which are welded to the top section 41 of wall section 36. Thus with the two doors 26 and 36 moved manually to a nearly closed position, the piston rod 59 is moved to its outermost extended position and the pin 60 is inserted into the slots 61 and 62. Thereafter hydraulic fluid is supplied to cylinder 55 and the piston rod 59 is drawn inwardly so as to force the doors 26 and 36 into their closed positions.

Hydraulic liquid under pressure is supplied to cylinder 55 through line 65 and valve 66 from a source of hydraulic fluid 67. The reservoir 67 is a common reservoir which also serves under the control of push buttons 23, 24 and 25 to operate the conventional hydraulic mechanism which operates the ram.

The bottom portions of the wall sections 26 and 36 are also held in their closed positions by means of hydraulic cylinder 70 and clamps 71 and 72 which are controlled by piston rod 73. Fluid to cylinder 70 is supplied from conduit 65.

Figure 5:
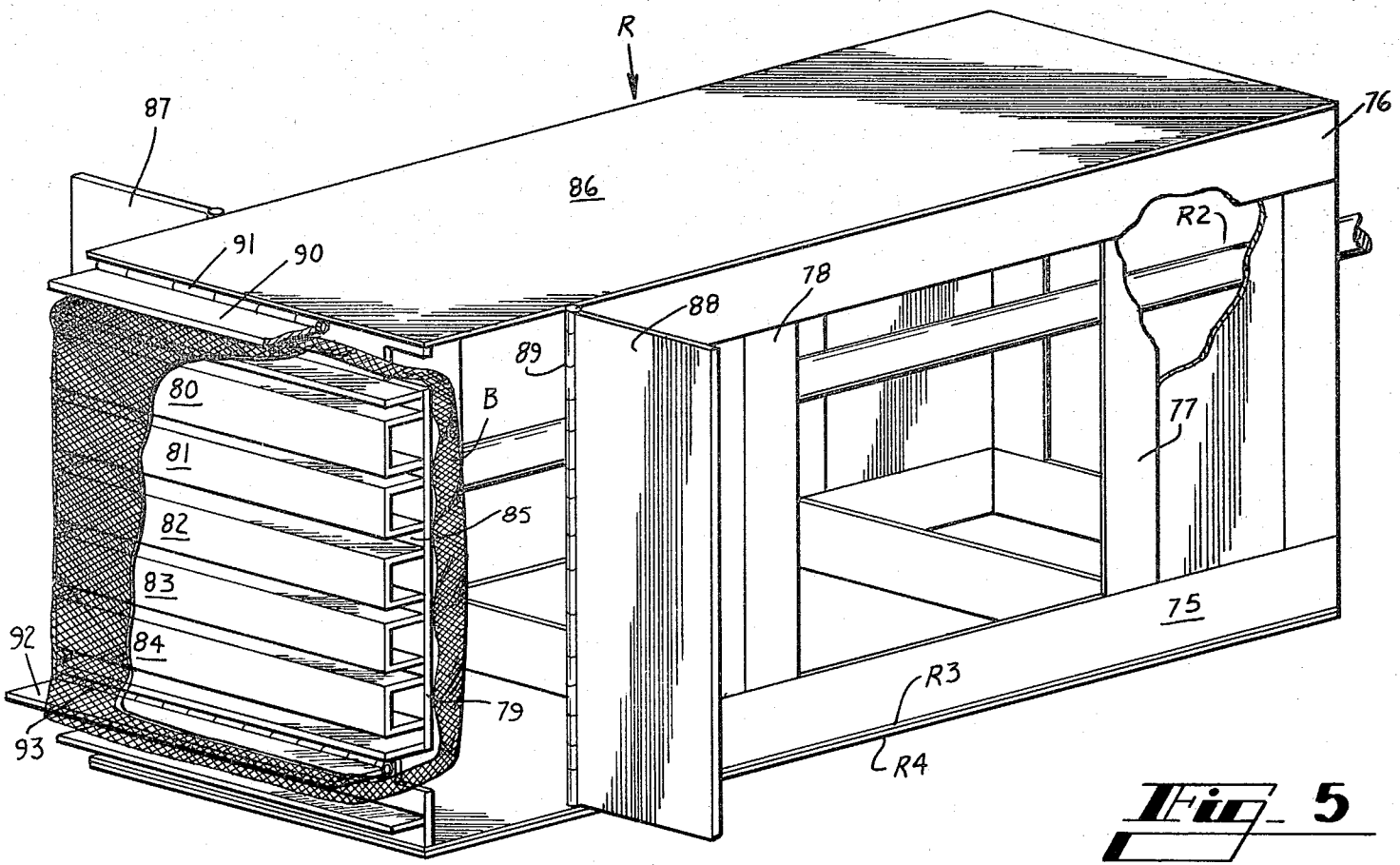
FIG. 5 is an isometric view of a ram formed according to this invention and which depicts portions of a bagging cavity disposed about the baling face of the ram and which shows the doors of the baling cavity in open position.

The ram is best shown in FIG. 5 and includes horizontal lower channel 75 and an upper channel 76 interconnected by vertical supports 77 and 78. A vertically disposed plate 79 is secured to horizontal channels 75 and 76 and to corresponding horizontal channels on the opposite side of the ram and serves as support for the horizontal channels 80–84 which are secured in vertically spaced relation so as to define a plurality of grooves 85 as best seen in FIG. 5. A top plate 86 is secured to the channel 76 and to a corresponding channel on the opposite side of the device. A bottom plate R3 is also secured to the channel 75 and to a corresponding channel on the opposite side of the device and a low friction plate R4 such as Teflon is secured to the lower surface of plate R3. Low friction material is also mounted on sides of channels 75 and 76 for effecting a guiding action.

The channels 80–84 constitute the baling face of the ram. In accordance with one feature of this invention, a bagging sheet is mounted so that its central portion overlies the channels 80–84 and so that its peripheral portions are tucked into a bagging cavity disposed about the periphery of the baling face of the ram R. As is apparent in FIG. 5 the bagging B is shown tucked into the bagging cavity which during baling operations is closed by the vertical doors 87 and 88 which are hingedly mounted to the frame of the ram R as indicated at 89 for example. An upper horizontal door 90 is hinged at 91 while a lower door 92 is hinged at 93 to the lower part of the ram R both of which doors pivot downward to close the bagging cavity. Thus with the peripheral portions of the bagging B tucked around the periphery of the baling face of the Ram R and with the center portion of the bagging overlying the baling face, the doors 87, 88, 90 and 92 are closed. The bagging is installed when the ram projects outwardly several inches from the channels 12 and 12*a* so that ready access thereto may be had and so that the doors 87, 88, 90 and 92 may be manually opened to accommodate tucking of the peripheral portions of the bagging B into the bagging cavity around the baling face of the ram R. With the doors closed, and with the bagging in place, the device is in condition for performing a baling operation.

A similar bagging sheet B1 is mounted on the platen 45 with its central portion overlying the baling face of the platen 45 and with its peripheral portions captured between the side edges of platen 45 and the end edges of wall sections 26 and 36.

Figure 6:
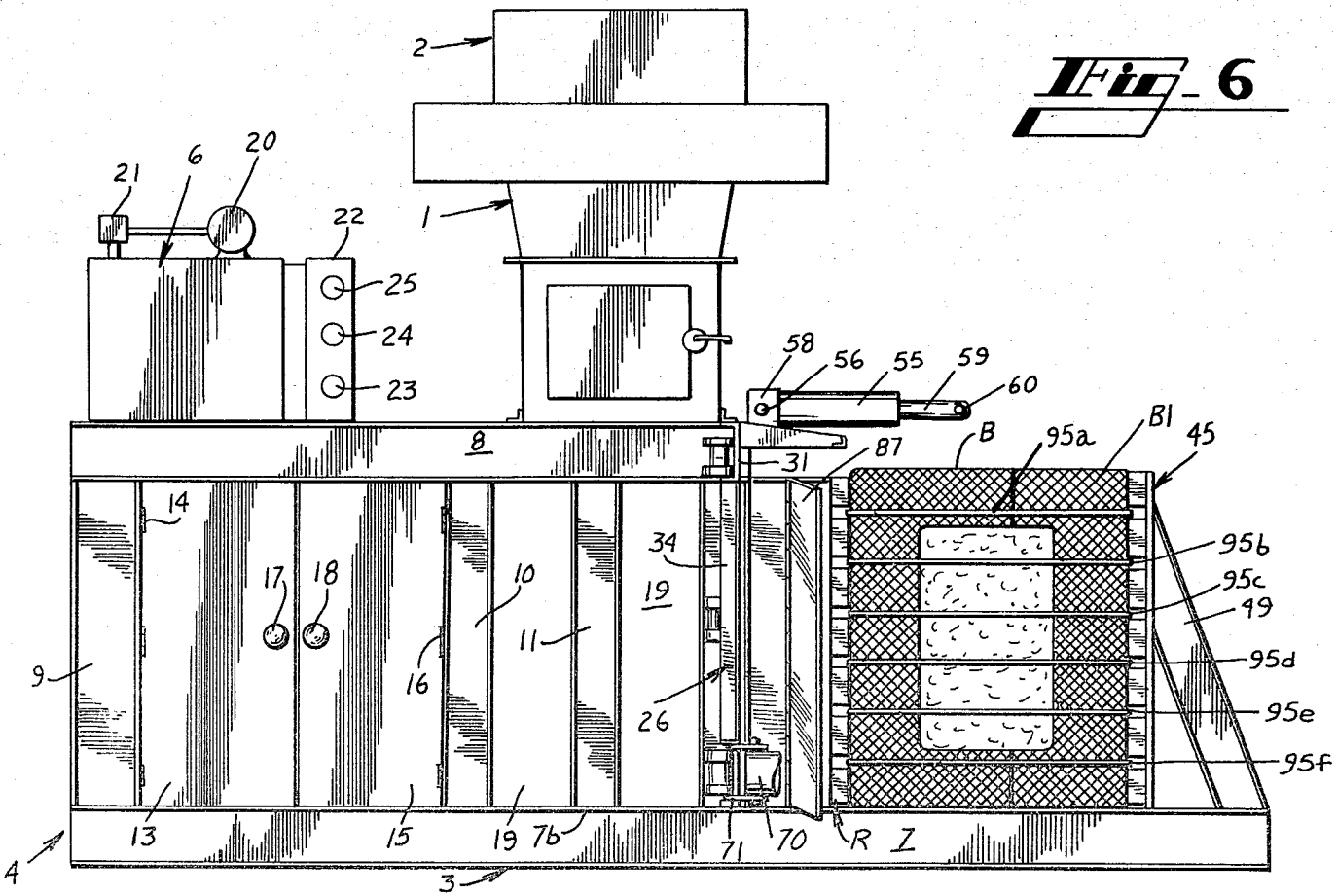

During operation, material to be baled is supplied through conduit 2 and hopper 1 into collection chamber 3 and switch 25 of control panel 22 is moved to its automatic position. As is well known, the ram operates automatically as material is fed into the collection chamber. Each time the hopper is filled the ram compresses the material into the baling chamber 5 and does so repeatedly until there is enough material in the baling chamber to make a complete bale. This condition is sensed by well known automatic pressure responsive devices and when this condition occurs an alarm is sounded and the operator then turns the switch 25 from automatic to hand operated position. Thereafter the forward button 24 is pressed to extend the ram into firm contact with the material which has been compressed as is best shown in FIG. 6. Valve 66 is then operated to release the hydraulic locking devices 55 and 70 and the wall sections 26 and 36 are moved manually to their open positions after the locking cylinders 55 and 70 are fully extended and their locking pins detached. The wall sections 26 and 36 are manually swung to their open positions through an angle of approximately 160°. With access to the baled material thus established, the peripheral portion of bagging sheet B1 is manually placed over the top half of the bale and along its sides. The peripheral portions of the bagging sheet B are removed through access doors 87 and 88 which are open. This portion of the bagging B is manually placed along the sides of the bale. Doors 90 and 92 cannot be opened with the ram in contact with the bale. The bagging is held in place by suitable picks or spikes. A baling tie 95*a* of the proper length is then inserted through one of the grooves such as the upper groove 85 and around the back of the baled material and through the upper groove 47 formed in the platen to the front so as to envelope the bagging B1 on the platen 45 as well as the bagging B and the leading and trailing ends of the tie 95*a* are attached. After all six ties 95*a* -95*f* are inserted in the manner described with their free ends adjacent one side of the bale such as the side adjacent to wall section 26, the loose ends are interconnected by known means manually and then secured in tightened condition. Thereafter the reverse button 24 is actuated to move the ram out of contact with the bale allowing access to doors 90 and 92 to be opened for removal of remaining bagging B and then fold the bagging from the top bagging pocket over the top of the bale and actuate the forward button so as to drive the ram into contact with the bale and compress the bale enough to allow the top part of the bagging B overlying the top of the bale to be tucked under the top bale tie 95*a*. The reverse button 23 is then acutated so as to retract the ram sufficiently to allow the bale to be pushed onto its side. Thereafter the remaining bagging B and B1 is folded over the bottom of the bale and tucked under the bottom bale tie 95*f*. The completed bale is then removed by suitable means such as a lift truck.

Once this operation is completed, the apparatus is in condition for repeating the above described procedure thereby to form a succeeding bale.

INDUSTRIAL APPLICABILITY

By this invention bales of material may be formed which include bagging as component parts and which therefore are less subject to expansion of the baled material in portions of the bale which are intermediate the ties and also the bale is rendered substantially more secure and thus less likely to fall apart and cause a littering problem and baled material is protected from contamination while in storage.

I claim:

1. Baling apparatus comprising a support frame, a material collecting chamber mounted on said frame and having an inlet to receive material to be baled and having an outlet for discharging said material, a ram reciprocably movable in a horizontal plane in said collecting chamber, a platen fixedly mounted on said support frame in spaced relation to said outlet of said material receiving chamber and having a baling face forming a part of a baling chamber, and movable mounted wall means supported by said support frame and interposed between said platen and said outlet of said receiving chamber to form a part of said baling chamber when disposed in closed baling position, said wall means being movable to an open position to afford access to the interior of said baling chamber, said ram including a baling face and a bagging cavity adjacent said baling face for retaining peripheral portions of a bagging sheet the central portion of which is arranged in overlying relation to said baling face, said ram further having a pair of doors hingedly secured thereto on vertical axes respectively on opposite sides thereof and a door hingedly secured thereto on a horizontal axis at at least one of the top or bottom portions thereof, said doors when closed enclosing portions of said bagging cavity to retain said peripheral portions of said bagging sheet within said bagging cavity during formation of a bale.

2. Baling apparatus according to claim 1 wherein said wall means comprises a pair of side wall sections hingedly mounted on opposite sides of said baling chamber.

3. Baling apparatus according to claim 2 wherein each of said side wall sections includes a top portion which forms a part of the top wall of said baling chamber.

4. Baling apparatus according to claim 2 wherein disjointable locking means is arranged when locked to hold said wall sections in closed baling positions.

5. Baling apparatus according to claim 2 wherein hydraulic means is arranged to move said wall sections to their closed baling positions.

6. Baling apparatus according to claim 1 wherein said baling face is of generally rectangular configuration.

7. Baling apparatus according to claim 1 wherein said at least one door comprises a pair of horizontal doors which are hingedly mounted respectively on the top and bottom portions of said ram.

8. Baling apparatus according to claim 1 wherein a plurality of horizontal grooves are formed in vertically spaced relation on the baling face of said ram.

9. Baling apparatus according to claim 1 wherein a plurality of horizontal grooves are formed in vertically spaced relation on the baling face of said platen.

* * * * *

UNITED STATES PATENT AND TRADEMARK OFFICE

CERTIFICATE OF CORRECTION

PATENT NO. : 4,360,997

DATED : November 30, 1982

INVENTOR(S) : George F. Smith, Jr.

It is certified that error appears in the above-identified patent and that said Letters Patent are hereby corrected as shown below:

Column 3, line 39, "60" should read--61--.

Column 6, claim 1, line 3, "movable" should read--movably--.

Signed and Sealed this

*Twenty-second* Day of *February 1983*

[SEAL]

*Attest:*

GERALD J. MOSSINGHOFF

*Attesting Officer*

*Commissioner of Patents and Trademarks*